US011413517B2

(12) United States Patent
Ritter

(10) Patent No.: US 11,413,517 B2
(45) Date of Patent: Aug. 16, 2022

(54) TAIL CLIP KITS, SKIN ASSEMBLIES, AND SYSTEMS FOR SPLITBOARD SKIS

(71) Applicant: SPARK R&D IP HOLDINGS, LLC, Bozeman, MT (US)

(72) Inventor: William J. Ritter, Bozeman, MT (US)

(73) Assignee: SPARK R&D IP HOLDINGS, LLC, Bozeman, MT (US)

( * ) Notice: Subject to any disclaimer, the term of this patent is extended or adjusted under 35 U.S.C. 154(b) by 0 days.

(21) Appl. No.: 17/157,498

(22) Filed: Jan. 25, 2021

(65) Prior Publication Data

US 2021/0228971 A1 Jul. 29, 2021

Related U.S. Application Data

(60) Provisional application No. 62/965,719, filed on Jan. 24, 2020.

(51) Int. Cl.
*A63C 11/00* (2006.01)
*A63C 5/02* (2006.01)

(52) U.S. Cl.
CPC ..... *A63C 11/00* (2013.01); *A63C 5/02* (2013.01)

(58) Field of Classification Search
CPC .. A63C 11/00; A63C 5/02; A63C 7/02; A63C 7/04
See application file for complete search history.

(56) References Cited

U.S. PATENT DOCUMENTS

| | | | | |
|---|---|---|---|---|
| 6,604,755 | B2 * | 8/2003 | Ayliffe | A63C 11/00 280/604 |
| 8,474,853 | B2 * | 7/2013 | Rogers | A63C 7/04 280/604 |
| 10,434,398 | B1 * | 10/2019 | McCarthy | A63C 7/02 |
| 10,543,418 | B1 * | 1/2020 | Scicchitano | A63C 7/04 |
| 2006/0267332 | A1 * | 11/2006 | Fischli | A63C 7/04 280/809 |
| 2007/0114779 | A1 * | 5/2007 | Ametsbichler | A63C 7/02 280/809 |
| 2008/0023956 | A1 * | 1/2008 | Fischli | A63C 7/04 280/809 |
| 2016/0199722 | A1 * | 7/2016 | Ritter | A63C 7/12 280/617 |
| 2017/0120136 | A1 * | 5/2017 | Shute | A63C 7/02 |
| 2017/0252636 | A1 * | 9/2017 | Gasparro | A63C 7/08 |

* cited by examiner

*Primary Examiner* — Brian L Swenson
(74) *Attorney, Agent, or Firm* — Snell & Wilmer L.L.P.

(57) ABSTRACT

A nose clip and a tail clip for a splitboard ski assembly may each comprise at least three hooks. The nose clip and the tail clip may be adaptable to various splitboard ski designs. A stretcher for a skin assembly may be configured to interface with the tail clip. The tail clip may comprise at least two elongated apertures defining a rail. The stretcher may be configured to interface with the rail via friction and/or secure a skin assembly to a splitboard ski assembly.

23 Claims, 8 Drawing Sheets

SECT A-A

SECT B-B

TAIL CLIP KITS, SKIN ASSEMBLIES, AND SYSTEMS FOR SPLITBOARD SKIS

CROSS-REFERENCE TO RELATED APPLICATIONS

This application is a non-provisional of, and claims priority to and the benefit of, U.S. Provisional Application No. 62/965,719, titled "SPLITBOARD SKI SKIN ASSEMBLIES AND SYSTEMS THEREFOR," filed on Jan. 24, 2020, which is hereby incorporated by reference in its entirety.

FIELD

The present disclosure relates to skin assemblies for splitboard skis, and more specifically to an improved tail clip, nose clip, and stretcher for splitboard skin systems.

BACKGROUND

A splitboard is a type of snow sport equipment that combines the features of a snowboard and snow skis. Splitboards can be optionally separated into two splitboard skis or coupled to create a unitary snowboard. Typically, users operate the splitboard as separate splitboard skis, known as touring mode, when climbing uphill or cross-country skiing; users operate the splitboard as a joined snowboard, known as riding mode, when negotiating downhill slopes.

Splitboard performance in touring mode is improved when a skin is coupled to each splitboard ski. The skin generates increased friction and/or traction with the snow when the ski moves in a rearward direction but generates reduced friction when the ski moves in a forward direction. In this way, the skin facilitates uphill climbing and/or reduces rearward sliding when it is coupled to a splitboard ski. When a skin is improperly aligned, coupled too loosely, or stretched too tightly on the splitboard ski, touring may become difficult for a given user. Additionally, with various new design concepts and changing board shapes, an adaptable nose clip and tail clip that can be used on multiple board shapes may be desired by splitboard riders.

SUMMARY

A tail clip, a nose clip, and a stretcher for use in a splitboard ski assembly are disclosed herein. The tail clip, nose clip, and the stretcher are adaptable to various splitboard ski designs, including standard designs, deep swallowtail designs, shallow swallowtail designs, square designs, and the like. The tail clip includes at least three hooks. One of the at least three hooks is configured to engage a first edge of a respective splitboard ski, and at least one of the second hook and the third hook is configured to engage a second edge of the respective splitboard ski. Similarly, the nose clip includes at least three hooks. One of the at least three hooks is configured to engage a first edge of a respective splitboard ski, and at least one of the second hook and the third hook is configured to engage a second edge of the respective splitboard ski.

The tail clip includes at least two elongated apertures defining a rail. The rail is configured to frictionally interface with a stretcher of a skin assembly. Each elongated aperture may be substantially longer than a width of the stretcher. The stretcher may comprise a plurality of protrusions configured to frictionally interface with the rail. The stretcher and tail clip assembly may be configured to allow more variability in the interface between stretcher and tail clip.

In various embodiments, the present disclosure provides tail clip kit for a splitboard ski system comprising a tail clip comprising a plurality of hooks configured to engage a tail end of a splitboard ski, the tail clip including a plurality of elongated apertures, and a stretcher comprising a base and a strap, the base configured to be coupled to a skin of a splitboard ski assembly, the strap extending outward from the base and configured to engage the plurality of elongated apertures, the strap configured to provide a friction interface with the tail clip.

In various embodiments, the stretcher further comprises a plurality of protrusions extending outward from a surface of the strap. In various embodiments, the plurality of protrusions is aligned in rows, each row of protrusions forming a chevron shape. In various embodiments, the tail clip further comprises a plate portion, the plurality of elongated apertures includes a first elongated aperture and a second elongated aperture, the first elongated aperture and the second elongated aperture are each disposed through the plate portion, and the first elongated aperture is disposed adjacent to the second elongated aperture and defines a first rail therebetween. In various embodiments, the plurality of elongated apertures further comprises a third elongated aperture disposed adjacent to the second elongated aperture and defines a second rail therebetween. In various embodiments, the strap of the stretcher is configured to create the friction interface with the first rail and the second rail. In various embodiments, the plurality of hooks comprises a first hook, a second hook, and a third hook, and the first hook, the second hook, and the third hook each extend outward from a mating surface of the tail clip. In various embodiments, the first hook comprises a first bending plane defining a first perpendicular axis, the second hook comprises a second bending plane defining a second perpendicular axis, and the third hook comprises a third bending plane defining a third perpendicular axis, the second perpendicular axis being offset from the first perpendicular axis by between 110 degrees and 140 degrees, and the third perpendicular axis being offset from the first perpendicular axis by between 90 degrees and 120 degrees. In various embodiments, the tail clip kit further comprises a plurality of fasteners configured to couple the base of the stretcher to the skin.

In various embodiments, each elongated aperture in the plurality of elongated apertures is elongated in a lateral direction. Each elongated aperture in the plurality of elongated apertures may be spaced apart in a longitudinal direction from an adjacent elongated aperture in the plurality of elongated apertures. The tail clip may be adaptable to various splitboard shapes. The stretcher may be configured to be offset from a lateral center of an elongated aperture in the plurality of elongated apertures in a first lateral direction in response to the tail clip engaging a first board shape of the various splitboard shapes. The stretcher may be configured to be offset from the lateral center in a second lateral direction in response to the tail clip engaging a second board shape of the various splitboard shapes, the second lateral direction being opposite the first lateral direction. The stretcher may be configured to be substantially aligned through the later center in response to the tail clip engaging a third board shape of the various splitboard shapes. The stretcher may be configured to have at least one of an obtuse angle and an acute angle relative to the longitudinal direction.

In various embodiments, the present disclosure provides a skin assembly for a splitboard ski assembly, comprising a splitboard skin extending from a nose end to a tail end a nose clip coupled to the nose end of the splitboard skin, and a stretcher comprising a base and a strap, wherein the base is coupled to the tail end, the strap extends away from the tail end distal to the nose end, the strap configured to provide a friction interface with a tail clip of the splitboard ski assembly.

In various embodiments, the stretcher further comprises a plurality of protrusions extending outward from a surface of the strap. In various embodiments, the plurality of protrusions is aligned in rows, each row of protrusions forming a chevron shape. In various embodiments, the nose clip comprises a plate portion, a first hook, a second hook, and a third hook, and the first hook, the second hook, and the third hook each extend outward from a mating surface of the plate portion. In various embodiments, the nose clip further comprises a first leg, a second leg, and a third leg, the first leg extends from the first hook to the second hook, the third leg extends from the second hook to the third hook, and the second leg extends from the first hook to the second hook.

In various embodiments, the present disclosure provides a splitboard skin system comprising a tail clip comprising a first hook, a second hook, a third hook, and a plurality of elongated apertures, and skin assembly. In various embodiments, the skin assembly comprises a splitboard skin, a nose clip coupled to a nose end of the splitboard skin, and a stretcher extending from a tail end of the splitboard skin distal to the nose end, the stretcher configured to frictionally engage at least one rail defined by the plurality of elongated apertures.

In various embodiments, a length of an aperture in the plurality of elongated apertures is substantially longer than a width of the stretcher. In various embodiments, the plurality of elongated apertures includes a first elongated aperture disposed adjacent to a second elongated aperture defining a first rail therebetween, and a third elongated aperture disposed adjacent to the second elongated aperture defining a second rail therebetween. In various embodiments, the first elongated aperture, the second elongated aperture, and the third elongated aperture each extend in a lateral direction and are spaced apart in a longitudinal direction. In various embodiments, the nose clip is configured to engage a first end of a splitboard ski, and the tail clip is configured to engage a second end of the splitboard ski. In various embodiments, the stretcher includes a stretcher axis defined by a stretcher edge of the stretcher, the stretcher edge defined by an intersection between a first surface and a side surface of the stretcher, the first surface including a plurality of protrusions extending therefrom, an elongated aperture in the plurality of elongated apertures includes an elongated aperture axis defined by a centerline of the elongated aperture in an elongation direction, and the splitboard skin system is configured to accommodate an angle between the stretcher axis and the elongated aperture axis being one of acute or obtuse.

A tail clip is disclosed herein. The tail clip may comprise a plate portion; a plurality of hooks extending from the plate portion; a plurality of elongated apertures extending through the plate portion, wherein: the tail clip configured to engage a tail end of a splitboard ski, each elongated aperture in the plurality of elongated apertures is elongated in a lateral direction and spaced apart in a longitudinal direction, the tail clip is adaptable to various splitboard shapes, the tail clip is configured to receive a stretcher that is offset from a lateral center of an elongated aperture in the plurality of elongated apertures in a first lateral direction in response to the tail clip engaging a first board shape of the various splitboard shapes, the tail clip is configured to receive the stretcher that is offset from the lateral center in a second lateral direction in response to the tail clip engaging a second board shape of the various splitboard shapes, the second lateral direction being opposite the first lateral direction, and the tail clip is configured to receive the stretcher that is substantially aligned with the lateral center in response to the tail clip engaging a third board shape of the various splitboard shapes.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
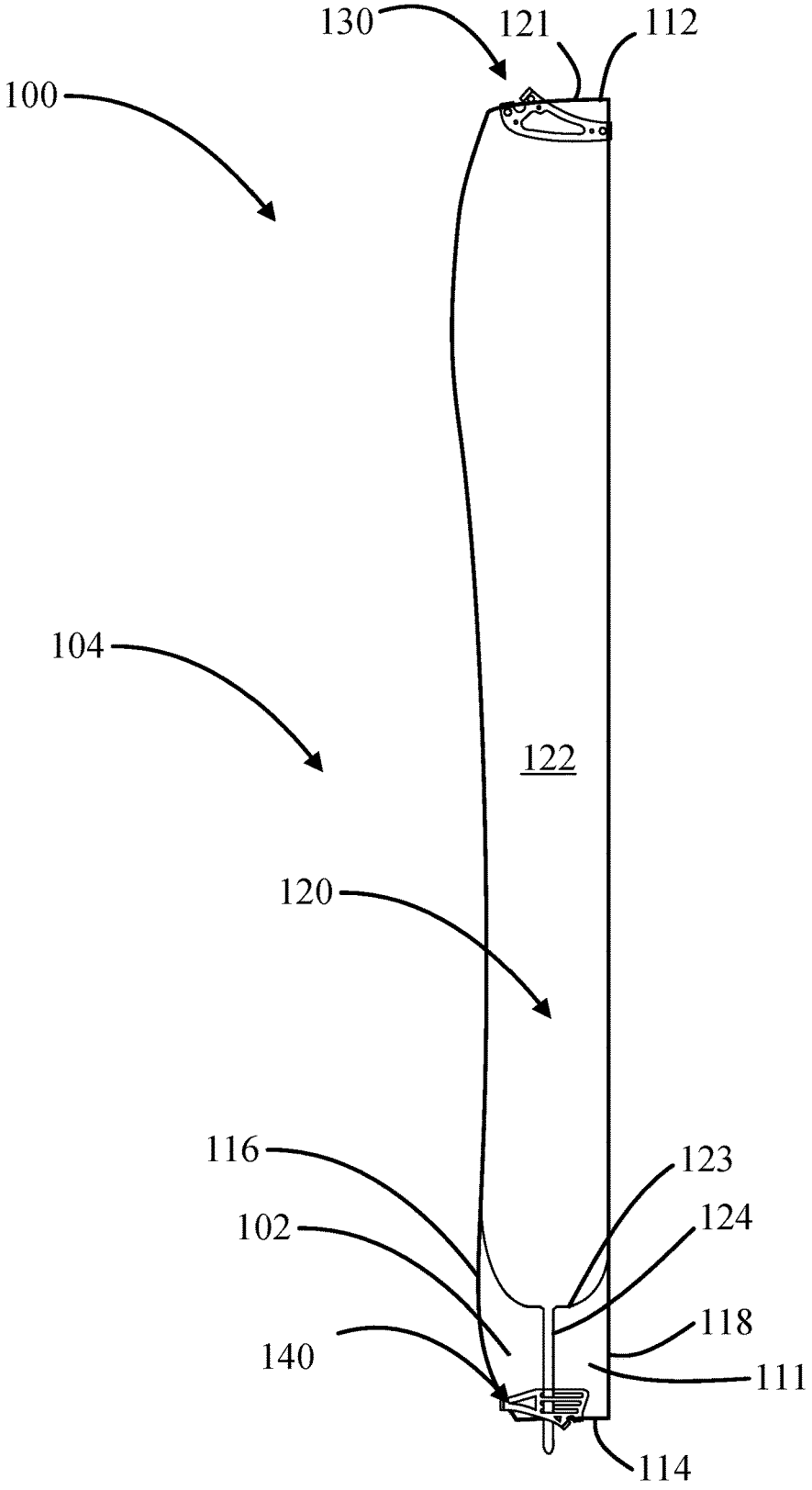
FIG. 1 is a bottom view of a splitboard ski assembly for use in touring mode, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. For example, while the detailed description herein illustrates embodiments of splitboard ski skin assemblies, the inventive aspects of the disclosure are applicable to cross-country skis, snow skis, and the like. Thus, the detailed description herein is presented for purposes of illustration only and not of limitation.

A splitboard ski assembly for use in touring mode, in accordance with various embodiments, is disclosed herein. "Touring mode," as disclosed herein, refers to a mode where a user utilizes splitboard skis to climb uphill, and/or for skinning, cross-country skiing, or other use of the splitboard with the skis separated. The splitboard ski assembly may generally comprise a splitboard ski, a skin assembly, and a nose clip. The skin assembly may comprise a skin portion having a nose end and a tail end. A stretcher may be coupled to the tail end. The nose clip may be coupled to the nose end of the skin portion. The skin portion may be configured to be coupled to a bottom surface of the splitboard ski for use in touring mode. The splitboard ski assembly may further comprise a tail clip configured to engage a tail end of the splitboard ski. The stretcher may be configured to extend through the tail clip and further secure the skin assembly to the splitboard ski assembly.

The tail clip and nose clip, as disclosed herein, are adaptable to various splitboard ski designs. For example, the tips and tails of splitboard skis may have various shapes, including rounded, elliptical, blunt, broad, square, swallowtail, or any other shape. A tail clip and/or nose clip, as disclosed herein, may comprise a plurality of hooks, each hook disposed at a different angle, such that at least one hook is capable of engaging an outboard edge of the splitboard ski, and at least one hook is capable of engaging an inboard edge of the splitboard ski.

A nose clip, as disclosed herein, may comprise a first hook, a second hook, and a third hook. The first hook may be configured to engage one of an inboard edge or an outboard edge of the splitboard ski. At least one of the second hook or the third hook may be configured to engage an outboard edge or a nose end of a splitboard ski. The tail clip may comprise a first hook, a second hook, and a third hook. The first hook may be configured to engage an inboard edge or an outboard edge of the splitboard ski. At least one of the second hook and the third hook may be configured to engage an outboard edge or a tail edge of a splitboard ski.

The tail clip may include at least two elongated apertures. The elongated apertures may be configured to receive the stretcher of the skin assembly and/or secure the skin assembly to the splitboard ski. The elongated apertures may comprise a width substantially greater than the width of the stretcher. The elongated apertures may be configured to receive the stretcher at an angle such that the length of the stretcher is normal to the width of the elongated apertures. The elongated apertures may be configured to receive the stretcher at an angle such that the length of the stretcher is non-normal to the width of the elongated apertures. The elongated apertures may comprise a width sufficient to allow the tail clip to receive the stretcher, while also allowing the skin to be aligned and/or stretched substantially parallel to the length of the splitboard ski. Stated differently, the elongated apertures may be configured to receive the stretcher in various locations, for example, at the lateral center of the elongated apertures and/or to the right or left of the lateral center of the elongated apertures (e.g., as variously shown in FIG. 7), such that the skin can be tensioned in a direction substantially parallel to the splitboard ski. Substantially parallel alignment of the skin to the splitboard ski may improve skin adhesion and/or retention on the splitboard ski.

Referring now to FIG. 1, a bottom view of a splitboard ski assembly 100, in accordance with various embodiments, is illustrated. The splitboard ski assembly 100 comprises a splitboard ski 102 and a splitboard skin system 104. The splitboard skin system 104 may comprise a skin assembly 120 and a tail clip 140. The splitboard ski assembly 100 may be one of two splitboard skis that form a splitboard ski system. A second splitboard ski for use with splitboard ski assembly 100 may mirror splitboard ski assembly 100 about an inboard edge 118 of the splitboard ski 102. In this regard, with all components described herein, the mirror component may be manufactured for assembly with a second splitboard for use with splitboard ski assembly 100. In various embodiments, a tail end 114 of splitboard ski 102 may comprise any shape known in the art, such as a standard shape, a deep swallowtail shape, a shallow swallowtail shape, a square shape, or the like. The various shapes of a tail end 114 may benefit from adaptable splitboard skin system 104.

In various embodiments, skin assembly 120 includes a splitboard skin 122 and a stretcher 124. Splitboard skin 122 may extend from a nose end 121 of skin assembly 120 to a tail end 123 of skin assembly 120. Splitboard skin 122 may be removably coupled to splitboard ski 102 adjacent to surface 111 by any method known in the art, such as an adhesive, or the like. The surface 111 may be a bottom surface of splitboard ski 102. A "bottom surface" as referred to herein is a surface of a splitboard ski that contacts the snow when riding the splitboard ski downhill. The skin assembly 120 may further comprise a stretcher 124 disposed at tail end 123 of splitboard skin 122. The stretcher 124 may be configured to stretch, and create tension in, the splitboard skin 122 of the skin assembly 120 when coupling the skin assembly to the splitboard ski 102. By stretching the splitboard skin 122 of the skin assembly 120 during attachment of the skin assembly to the splitboard ski 102, the skin assembly may be more secure and/or allow for better traction during touring mode. In various embodiments, the stretcher 124 may be retrofitted to a splitboard skin 122 (i.e., manually coupled to a splitboard skin 122 by a consumer), or integral to a splitboard skin 122 (i.e., manufactured as a skin assembly 120). In various embodiments, splitboard skin 122 may comprise a contour and/or shape that is substantially similar to a perimeter of the splitboard ski 102 from nose end 121 of skin assembly 120 to tail end 123 of skin assembly 120.

In various embodiments, skin assembly 120 may further comprise a nose clip 130 disposed at the nose end 121 of skin assembly 120. The nose clip 130 may be coupled to the splitboard skin 122 by any method known in the art, such as rivets, fasteners, adhesives, or the like. The tail clip 140 may be disposed at a tail end 114 of splitboard ski 102. In various embodiments, the tail clip 140 may be configured to engage an outboard edge 116 and the tail end 114 of the splitboard ski 102. In various embodiments, the tail clip 140 may be configured to engage the inboard edge 118 and the tail end 114. The tail clip 140 is adaptable to various splitboard ski 102 designs.

The nose clip 130 is configured to engage a nose end 112 of the splitboard ski 102 and the tail clip 140 is configured to engage a tail end of 114 of splitboard ski 102. For example, nose clip 130 may engage nose end 112 and inboard edge 118 of the splitboard ski 102, securing the skin portion of skin assembly 120 to the nose end 112 of splitboard ski 102. The stretcher 124 of skin assembly 120 may then engage the tail clip 140 and be pulled through at least two elongated apertures of tail clip 140. The stretcher 124 may be configured to secure the skin assembly 120 to the tail clip 140. In this regard, a more optimal tension of splitboard skin 122 may be achieved compared to typical splitboard ski assemblies.

Figure 2A:
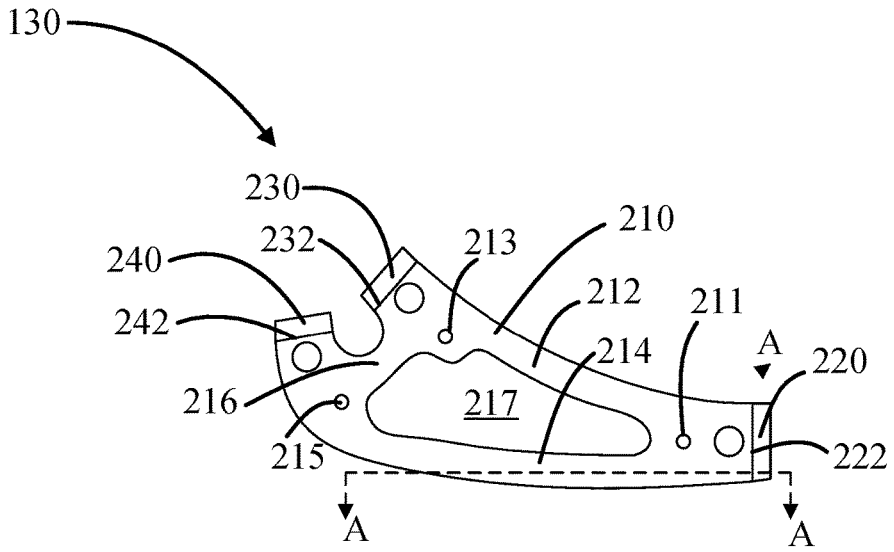
FIG. 2A illustrates a bottom view of a nose clip, in accordance with various embodiments.

Referring now to FIG. 2A, a bottom view of nose clip 130, in accordance with various embodiments, is illustrated. The nose clip 130 may comprise a plate portion 210, a first hook 220, a second hook 230, and a third hook 240. The plate portion 210 may be a flat portion and configured to interface with a splitboard skin 122 of skin assembly 120 from FIG. 1. The plate portion 210 may include a first leg 212 extending from first hook 220 to second hook 230. Similarly, the plate portion 210 may include a second leg 214 extending from the first hook 220 to the third hook 240. The plate portion 210 may further include a third leg 216 extending from the second hook 230 to the third hook 240. The third leg 216 may be substantially shorter than first leg 212 and second leg 214. "Substantially shorter," as referred to herein is at less than two thirds of the reference distance. In various embodiments, the second hook 230 and the third hook 240 may comprise a continuous hook. In various embodiments, the first hook 220 and the second hook 230 may comprise a continuous hook. In various embodiments, the first hook 220, the second hook 230, and the third hook 240 may comprise one continuous hook extending from first hook 220 to third hook 240 around a perimeter of first leg 212 and third leg 216. In various embodiments, the second hook 230 and the third hook 240 may comprise one continuous hook extending from the second hook 230 to the third hook 240 around a perimeter of the third leg 216. The first leg 212, second leg 214, and third leg 216 may define an aperture 217. In various embodiments, the plate portion 210 may comprise a solid plate portion (e.g., a plate without aperture 217) extending between the first hook 220, the second hook 230, and the third hook 240.

In various embodiments, the nose clip 130 may further comprise fastener apertures (e.g., first fastener aperture 211, second fastener aperture 213, and third fastener aperture 215). Each fastener aperture may be disposed proximate a hook (e.g., first fastener aperture 211 disposed proximate first hook 220, second fastener aperture 213 disposed proximate second hook 230, and third fastener aperture 215 disposed proximate third hook 240).

With combined reference to FIG. 2A and FIG. 1, the fastener apertures may be configured to receive fasteners to couple the nose clip 130 to splitboard skin 122 of skin assembly 120. Additionally, first hook 220 may be configured to engage inboard edge 118 of the splitboard ski 102 and at least one of the second hook 230 and the third hook 240 may be configured to engage the nose end 112 of splitboard ski 102. In this regard, by having second hook 230 and third hook 240 disposed proximate each other and at offset angles, the nose clip 130 may be adaptable to various splitboard ski designs. Although illustrated and discussed with respect to a three hook configuration, any number of additional hooks is within the scope of this disclosure. For example, a nose clip with four hooks may provide additional adaptability to changing splitboard ski designs.

In various embodiments, each hook may define a bend plane. A "bend plane," as disclosed herein, is a plane defined by a transition plane from plate portion 210 to a respective hook. For example, first hook 220 extends from a first bend plane 222 of first hook 220. The first bend plane 222 is defined by a location where the nose clip 130 transitions from a flat portion (e.g., plate portion 210) to a bending portion (e.g., first hook 220). In various embodiments, each plane may define a perpendicular axis from a center point of the plane. The orientation of each hook relative to each other may be defined by these axes. For example, an axis defined by first bend plane 222 of first hook 220 may be offset from an axis defined by second bend plane 232 of second hook 230 by between 110 degrees and 140 degrees, or by between 125 degrees and 135 degrees, or by approximately 130 degrees. An axis defined by first bend plane 222 of first hook 220 may be offset from third bend plane 242 of third hook 240 by between 90 degrees and 120 degrees, or between 95 degrees and 105 degrees, or by approximately 100 degrees.

Figure 2B:
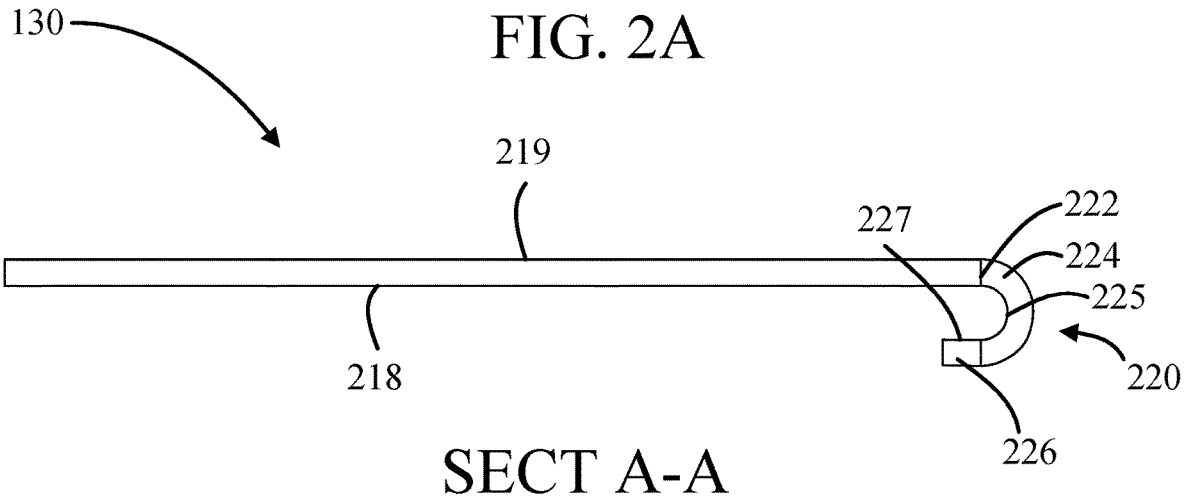
FIG. 2B illustrates a cross sectional view of a nose clip along section line A-A from FIG. 2A, in accordance with various embodiments.

Referring now to FIG. 2B, a cross-section view of nose clip 130 along section line A-A from FIG. 2A is illustrated, in accordance with various embodiments. The nose clip 130 may further comprise a mating surface 218 of plate portion 210. The mating surface 218 disposed opposite an outer surface 219 of the plate portion 210. With brief reference to FIG. 1, the mating surface 218 abuts the splitboard skin 122 of skin assembly 120. In various embodiments, first hook 220 further comprises a bend portion 224 extending from first bend plane 222 outward from mating surface 218. The bend portion 224 may be semi-annular in shape. The first hook 220 may further include a flat portion 226 extending from a tangent point of a second end of bend portion 224. The flat portion 226 may include mating surface 227. With brief reference to FIG. 1, mating surface 227 may interface a surface of splitboard ski 102 that is opposite surface 111 (e.g., a top surface of splitboard ski 102). In this regard, first hook 220 may be configured to wrap around an edge of splitboard ski 102 (e.g., outboard edge 116, inboard edge 118, or nose end 112) and engage a top surface and a bottom surface of splitboard ski 102 to secure a skin assembly 120 to splitboard ski 102. Similarly, bend portion 224 may include an inner surface 225 configured to mate with an edge of splitboard ski 102 (e.g., outboard edge 116, inboard edge 118, or nose end 112). In various embodiments, second hook 230 and/or third hook 240 may be in accordance with first hook 220. Although illustrated as including flat portion 226 and first hook 220 as having a semi-annular shape, the present disclosure is not limited in this regard. For example, any of the hooks may have an arc angle greater than or less than 180 degrees and/or not include flat portion 226.

In various embodiments, nose clip 130 may comprise a metal alloy (i.e., stainless steel, aluminum, titanium, or the like), a plastic, or any other clip material known in the art. In various embodiments, at least a portion of nose clip 130 may comprise a deformable material such that a hook of the nose clip may deform to fit the portion of the splitboard ski with which it is coupled. In various embodiments, such deformation may cause an axis of a bend plane of the hook to change.

Figure 3A:
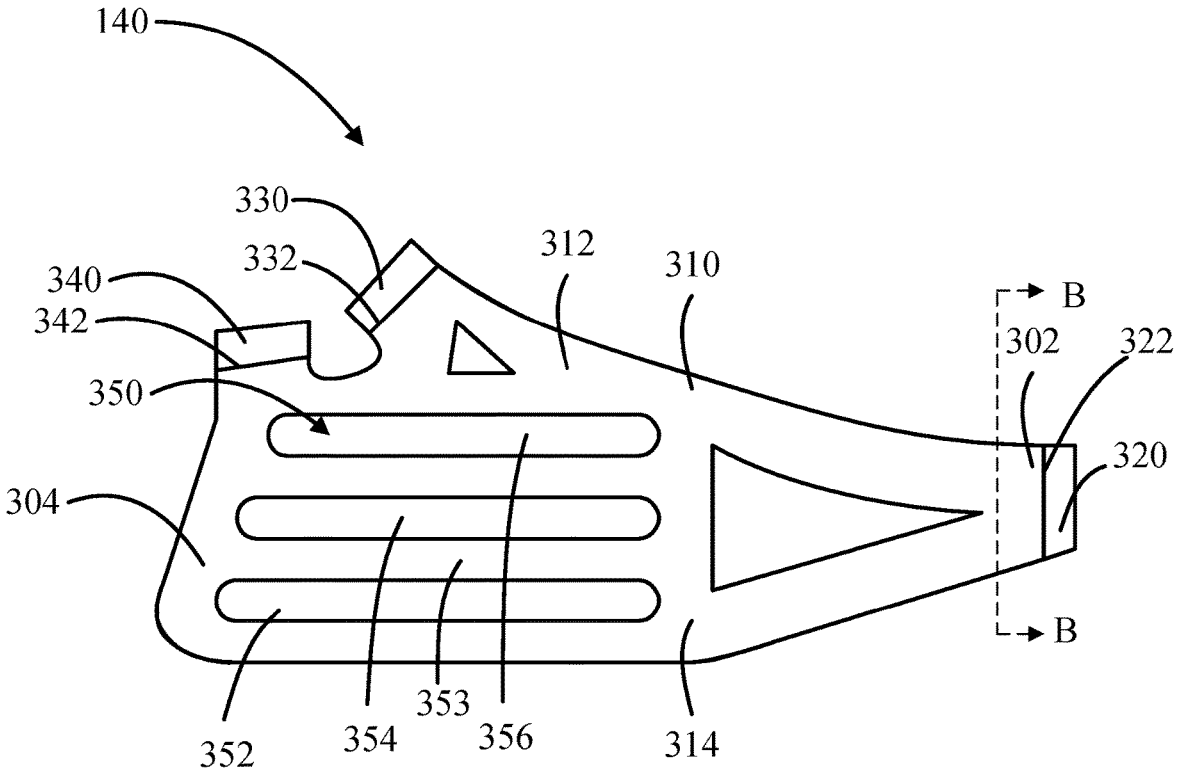
FIG. 3A illustrates a bottom view of a tail clip, in accordance with various embodiments.

Referring now to FIG. 3A, a bottom view of a tail clip 140, in accordance with various embodiments, is illustrated. The tail clip 140 may include a plate portion 310, a first hook 320, a second hook 330, and a third hook 340. The plate portion 310 may extend from a first end 302 proximate the first hook 320 to a second end 304. The plate portion 310 may include a first leg 312 extending from first hook 320 to second hook 330 and a second leg 314 extending from first hook 320 to second end 304. The first leg 312 may be disposed opposite the second leg 314. The third hook 340 may be disposed at second end 304 of the plate portion 310 and offset by an angle from first hook 320.

Figure 3B:
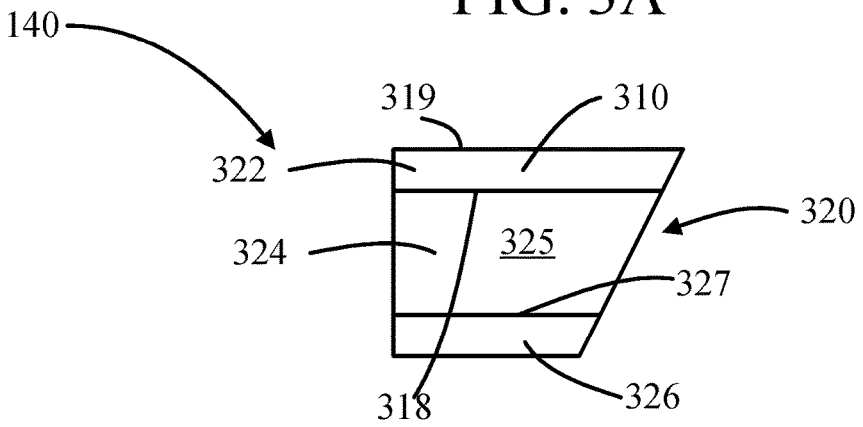
FIG. 3B illustrates a cross sectional view of a tail clip along section line B-B from FIG. 3A, in accordance with various embodiments.

With reference now to FIG. 3B, a cross-sectional view of tail clip 140 along section line B-B is illustrated, in accordance with various embodiments. With combined reference to FIGS. 2B, 3A, and 3B, in various embodiments, the first hook 320, the second hook 330, and the third hook 340 may each be in accordance with first hook 220 of nose clip 130.

Referring now to FIG. 3B, for example, the tail clip 140 may further comprise a mating surface 318 of plate portion 310. The mating surface 318 disposed opposite an outer surface 319 of the plate portion 210. With brief reference to FIG. 1, the mating surface 318 abuts the surface 111 of splitboard ski 102 when a splitboard ski assembly is assembled (e.g., as shown in FIG. 1). In various embodiments, first hook 320 further comprises a bend portion 324 extending from first bend plane 322 outward from mating surface 318. The bend portion 324 may be semi-annular in shape as shown in FIG. 2B with respect to first hook 220 of nose clip 130. The first hook 320 may further include a flat portion 326 extending from a tangent point of a second end of bend portion 324. The flat portion 326 may include mating surface 327. With brief reference to FIG. 1, mating surface 327 may interface a surface of splitboard ski 102 that is opposite surface 111 (e.g., a top surface of splitboard ski 102). In this regard, first hook 320 may be configured to wrap around an edge of splitboard ski 102 (e.g., outboard edge 116, inboard edge 118, or nose end 112) and engage a top surface and a bottom surface of splitboard ski 102 to secure a skin assembly 120 to splitboard ski 102. Similarly, bend portion 324 may include an inner surface 325 configured to mate with an edge of splitboard ski 102 (e.g., outboard edge 116, inboard edge 118, or nose end 112). In various embodiments, second hook 330 and/or third hook 340 may be in accordance with first hook 320. Although described herein as engaging a top surface and a bottom surface of splitboard ski 102, the present disclosure is not limited in this regard. For example, the first hook 320 may only engage one of the top surface or the bottom surface of the splitboard ski 102 and an edge of the splitboard ski 102, in accordance with various embodiments.

In various embodiments, plate portion 310 comprises a plurality of elongated apertures 350 disposed therethrough. Each elongated aperture in the plurality of elongated apertures 350 may extend in a direction that is substantially perpendicular to a first bend plane 322 of first hook 320. "Substantially perpendicular," as disclosed herein, refers to perpendicular +/−15 degrees. With brief reference to FIG. 1, each elongated aperture in the plurality of elongated apertures 350 may be configured to receive stretcher 124 of skin assembly 120 and/or secure the skin assembly 120 to the splitboard ski 102. The stretcher 124 may interleave between apertures and secure the skin assembly 120 via friction between the stretcher 124 of skin assembly 120 and the plate portion 310 of tail clip 140.

In various embodiments, the plurality of elongated apertures 350 comprise at least two apertures (e.g., first elongated aperture 352 and second elongated aperture 354). The first elongated aperture 352 may be disposed proximate second leg 314. The second elongated aperture 354 may be disposed adjacent to first elongated aperture 352. For example, first elongated aperture 352 may be disposed between second elongated aperture 354 and second leg 314. The first elongated aperture 352 and the second elongated aperture 354 may define a first rail 353 therebetween. During operation, the first rail 353 may interface with the stretcher 124 from FIG. 1 and secure the stretcher 124 to the tail clip 140.

Similar to nose clip 130 from FIG. 2, each hook may define a bend plane. First hook 320 extends from a first bend plane 322 of first hook 320. The first bend plane 222 is defined by a location where the tail clip 140 transitions from a flat portion (e.g., plate portion 310) to a bending portion (e.g., first hook 320). An axis defined by first bend plane 322 of first hook 320 may be offset from an axis defined by second bend plane 332 of second hook 330 by between 120 degrees and 140 degrees, or by between 125 degrees and 135 degrees, or by approximately 130 degrees. An axis defined by first bend plane 322 of first hook 320 may be offset from third bend plane 342 of third hook 340 by between 90 degrees and 110 degrees, or between 95 degrees and 105 degrees, or by approximately 100 degrees.

In various embodiments, tail clip 140 may comprise a metal alloy (i.e., stainless steel, aluminum, titanium, or the like), a plastic, or any other clip material known in the art. In various embodiments, at least a portion of tail clip 140 may comprise a deformable material such that a hook of the tail clip may deform to fit the portion of the splitboard ski with which it is coupled. In various embodiments, such deformation may cause an axis of a bend plane of the hook to change.

Referring now to FIG. 4, a bottom view of a stretcher 400, in accordance with various embodiments, is illustrated. In various embodiments, stretcher 124 from FIG. 1 is in accordance with stretcher 400. Stretcher 400 comprises a base 410 and an elongated strap 420 extending from the base 410. The base 410 may comprise a fastener aperture 412. In various embodiments, the base 410 may comprise a plurality of fastener apertures. For example, the base 410 may comprise a second fastener aperture 414 and/or a third fastener aperture 416. In various embodiments, the base 410 may utilize any attachment means known in the art, such as adhesives, bonding, sewing, or the like. In various embodiments, stretcher 400 may comprise a plurality of protrusions 430 extending outward from a first surface 422 of strap 420.

The plurality of protrusions 430 may be arranged in rows in any shape known in the art. In various embodiments, the plurality of protrusions 430 may be arranged in an adjacent rows of chevron patterns. In various embodiments, each row in the plurality of rows of the plurality of protrusions 430 may be spaced closely to the adjacent row. For example, a first protrusion in a first row may be disposed between 2.5 mm and 7.5 mm from an adjacent protrusion in a second row. With combined reference to FIGS. 1, 3A, and 4, by arranging the plurality of protrusions 430 in this manner, the strap 420 of stretcher 400 may be offset from the plurality of elongated apertures 350 and maintain frictional contact with the first rail 353 and/or second leg 314 of tail clip 140. In this regard, the stretcher 400 may allow for more variability in an amount of tension for a skin assembly 120. In various embodiments, stretcher 124 from FIG. 1 may be in accordance with stretcher 400. The stretcher 400 may be made from a thermoplastic material, such as thermoplastic urethane (TPU), thermoplastic elastomer (TPE), or the like, or any other elastomer known in the art.

Figures 4A, 4B:
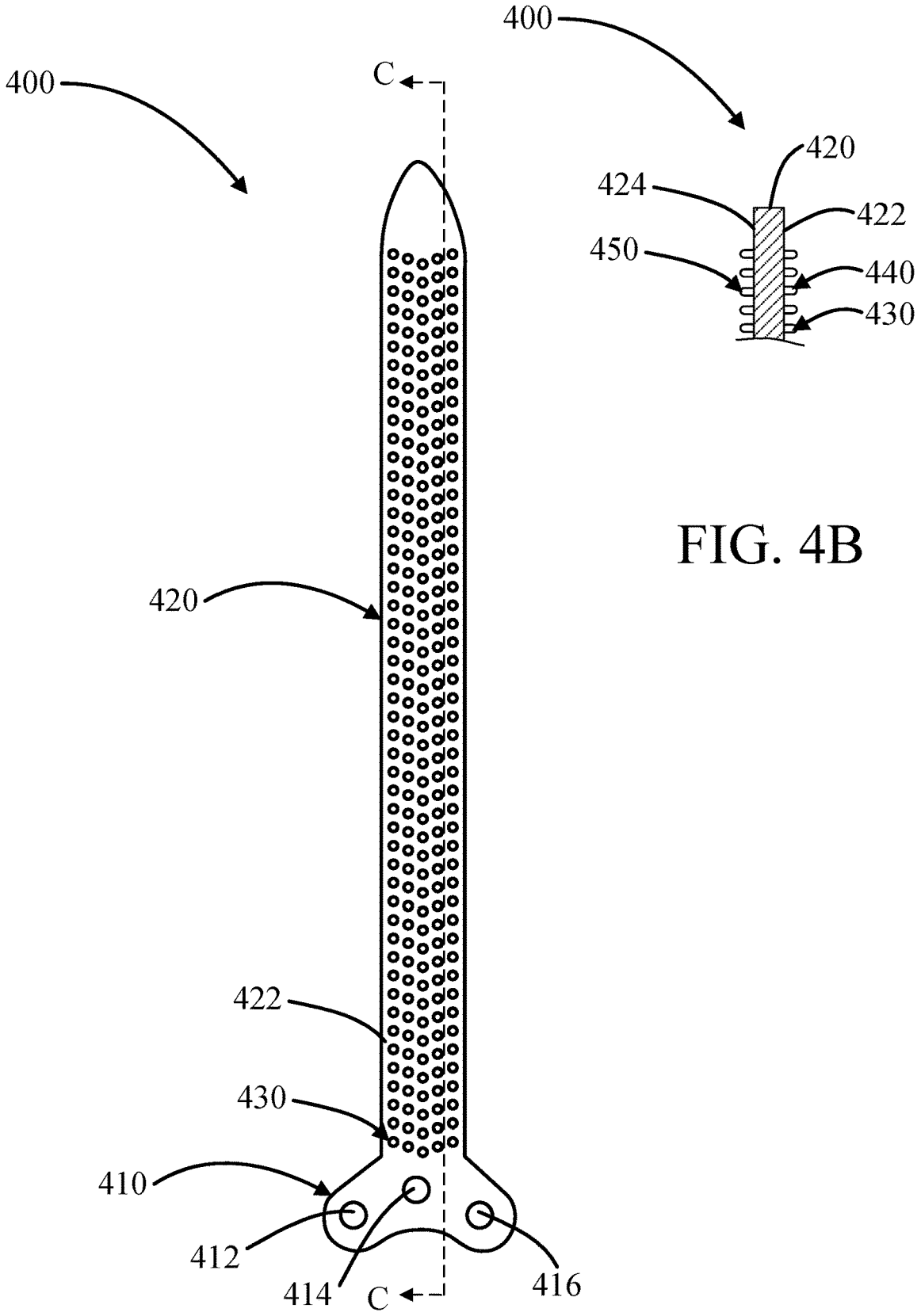
FIG. 4A illustrates a bottom view of a stretcher for a skin assembly, in accordance with various embodiments.
FIG. 4B illustrates a cross-sectional view of a portion of a stretcher along section line C-C of FIG. 4A, in accordance with various embodiments.

Referring now to FIG. 4B, a cross-section of a portion of strap 420 from FIG. 4A along section line C-C is illustrated, in accordance with various embodiments. In various embodiments, both sides of strap 420 may contain a plurality of protrusions 430. For example, first surface 422 of strap 420 is disposed opposite a second surface 424 of strap 420. Stretcher 400 may comprise a first plurality of protrusions 440 extending outward from first surface 422 of strap 420 and/or a second plurality of protrusions 450 extending outward from a second surface 424 of strap 420. In this regard, in various embodiments, both sides of strap 420 may be configured to secure the stretcher 400 to a respective tail clip (e.g., tail clip 140 from FIG. 3A) via a friction interface.

Figure 5:
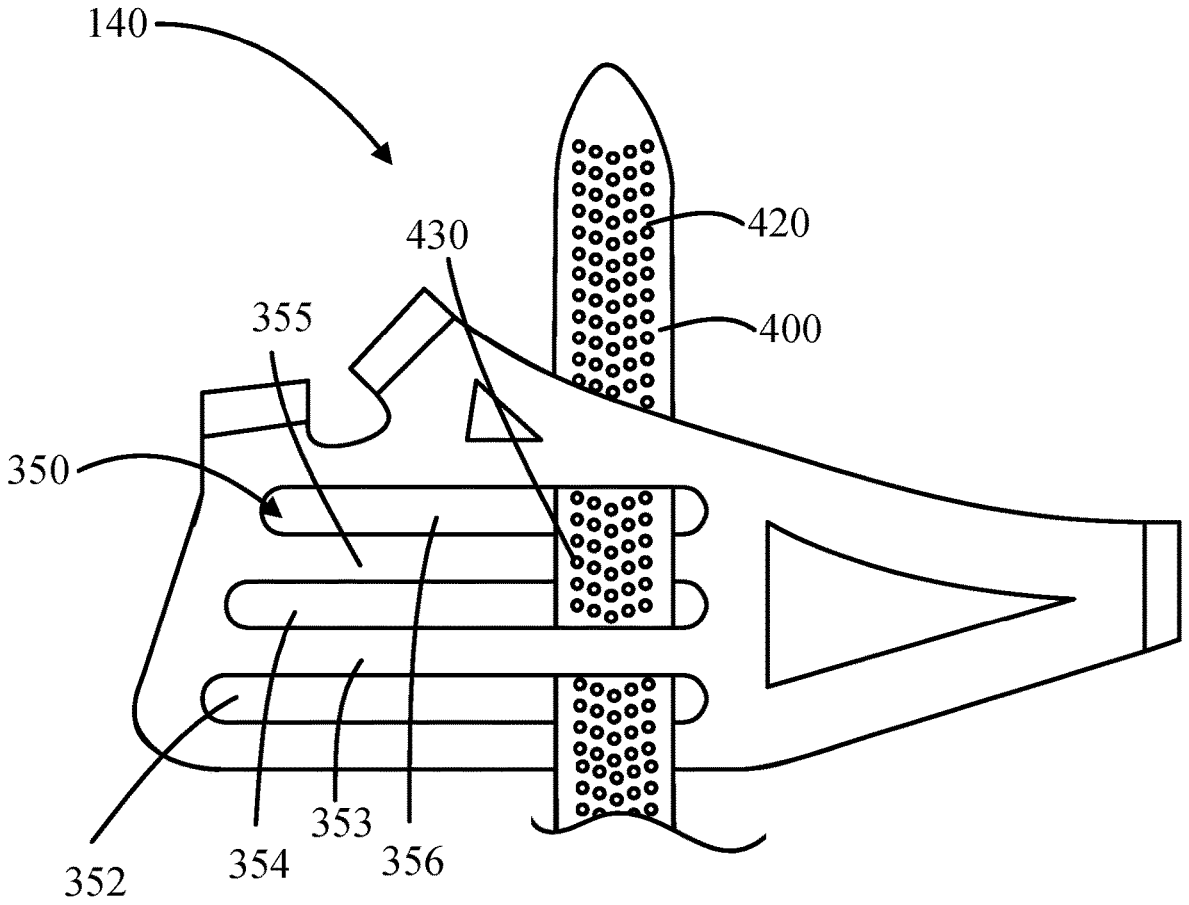
FIG. 5 illustrates a stretcher and tail clip interface, in accordance with various embodiments.

Referring now to FIG. 5, a stretcher and tail clip interface is illustrated, in accordance with various embodiments. The strap 420 of the stretcher 400 may interleave between first rail 353 and a second rail 355 defined by a third elongated aperture 356 and second elongated aperture 354. In various embodiments, a length each elongated aperture in the plurality of elongated apertures 350 may be substantially larger than a width of the strap. Substantially larger, as disclosed herein, is between 1.5 times larger and 10 times larger, or between 2 times larger, and 5 times larger, or approximately three times larger. In this regard, the strap 420 may be aligned in any orientation relative to the plurality of elongated apertures 350 and maintain a secure friction fit with tail clip 140 via the plurality of protrusions 430. Thus, the stretcher and tail clip interface, as disclosed herein may facilitate secure friction fits whether an angle between the strap 420 and an elongated aperture 352, 354, 356 is obtuse, perpendicular, or acute, in accordance with various embodiments. In this regard the stretcher 400 may include a stretcher axis defined by a stretcher edge of the stretcher. The stretcher edge may be defined by an intersection between a first surface and a side surface of the stretcher. The first surface may include a plurality of protrusions extending therefrom. An elongated aperture (352, 354, or 356) in the plurality of elongated apertures may include an elongated aperture axis defined by a centerline of the elongated aperture in an elongation direction.

Figure 6:
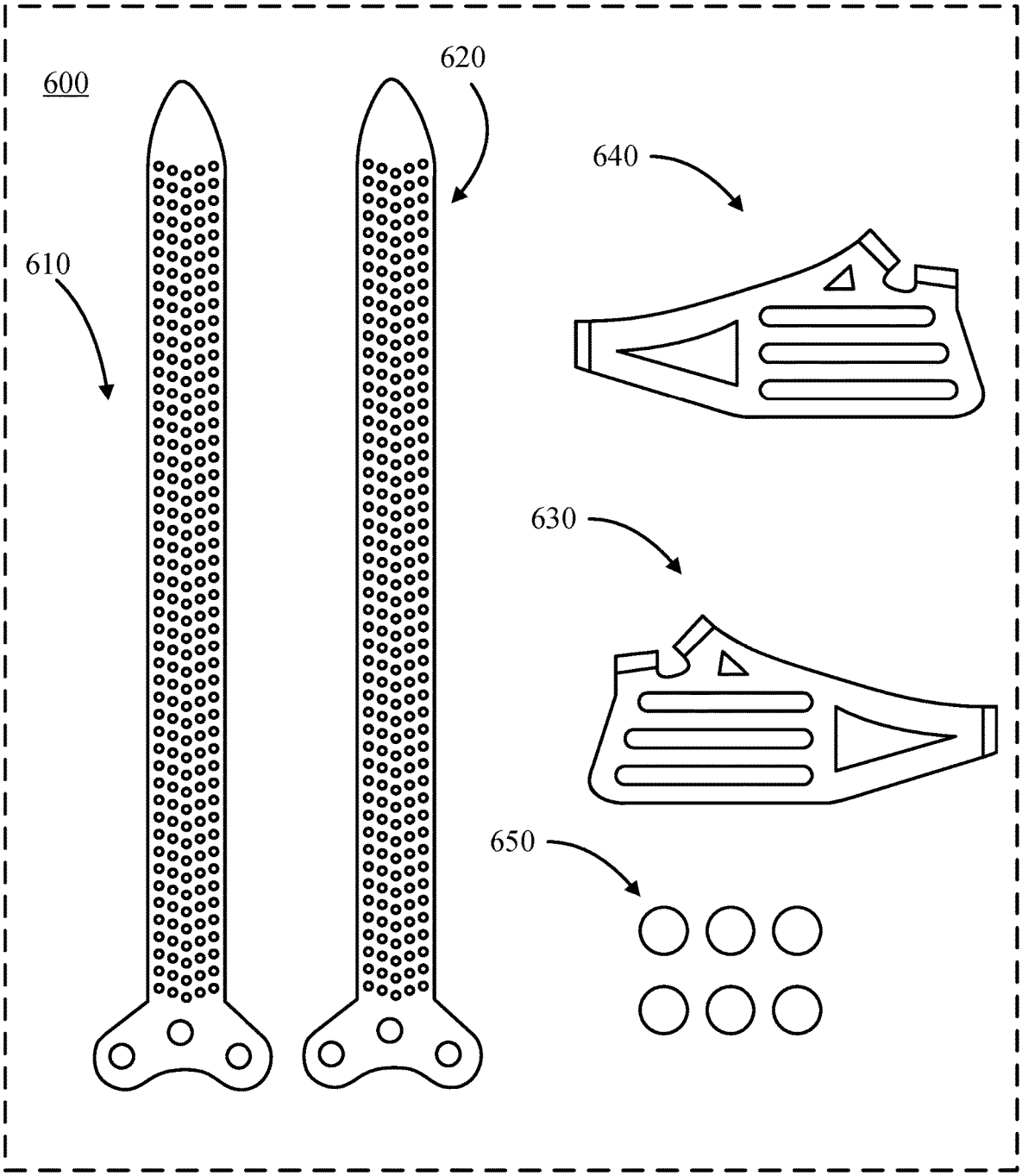
FIG. 6 illustrates a tail clip kit for retrofitting a splitboard skin system, in accordance with various embodiments.

Referring now to FIG. 6, a tail clip kit 600 for retrofitting a splitboard skin system is illustrated, in accordance with various embodiments. The tail clip kit 600 may comprise a first stretcher 610, a first tail clip 630, and a plurality of fasteners 650. In various embodiments, tail clip kit 600 may further comprise a second stretcher 620 and a second tail clip 640. In various embodiments, the first stretcher 610 and the second stretcher 620 are both in accordance with the stretcher 400 from FIGS. 4A/4B. In various embodiments, the first tail clip 630 is in accordance with the tail clip 140 from FIGS. 1, 3A, 3B. In various embodiments, the second tail clip 640 is a mirror of the first tail clip 630 about a first bend plane associated with a first hook of the first tail clip 630 (e.g., first hook 320 of FIG. 3A). In this regard, the first tail clip 630 may be configured to engage a first splitboard ski in a splitboard ski assembly, and the second tail clip 640 may be configured to engage a second splitboard ski in a splitboard ski assembly, in accordance with various embodiments.

In various embodiments, the plurality of fasteners 650 are configured to couple the first stretcher 610 to a first splitboard skin and the second stretcher 620 to a second splitboard skin. For example, the plurality of fasteners 650 may be configured to be disposed through the fastener apertures 412, 414, 416 from FIG. 4A and engage a splitboard skin on a first side of a respective fastener and a stretcher (e.g., stretcher 610, 620) on a second side of the respective fastener, the second side being opposite the first side.

In various embodiments, the tail clip kit 600 may be configured to retrofit a splitboard skin system with a tail clip and stretcher in accordance with the present disclosure. In this regard, the tail clip kit 600 may provide greater adjustability between the stretcher and tail clip interfaces to provide proper tension for the splitboard skin system. In various embodiments, the tail clip kit 600 may further facilitate securely coupling the stretcher to the tail clip when the stretcher is non-normal to the tail clip. In this regard, the elongated apertures of the tail clip allow for the stretcher to be secured to the tail clip at various angles, in accordance with various embodiments.

In various embodiments, a hardware kit may include the tail clip kit 600, as well as at least one nose clip 130 from FIGS. 2A-2B, and corresponding fasteners for coupling the at least one nose clip 130 to a skin assembly, such as fasteners 650. Similarly, a nose clip kit is within the scope of this disclosure. For example, a nose clip kit may include the nose clip 130 and corresponding fasteners, such as fasteners 650, for coupling the nose clip to a skin assembly. In this regard, if a nose clip of a skin assembly is damaged, a nose clip kit may be more beneficial for a lower cost as opposed to obtaining a hardware kit as outlined above, in accordance with various embodiments.

Figure 7:
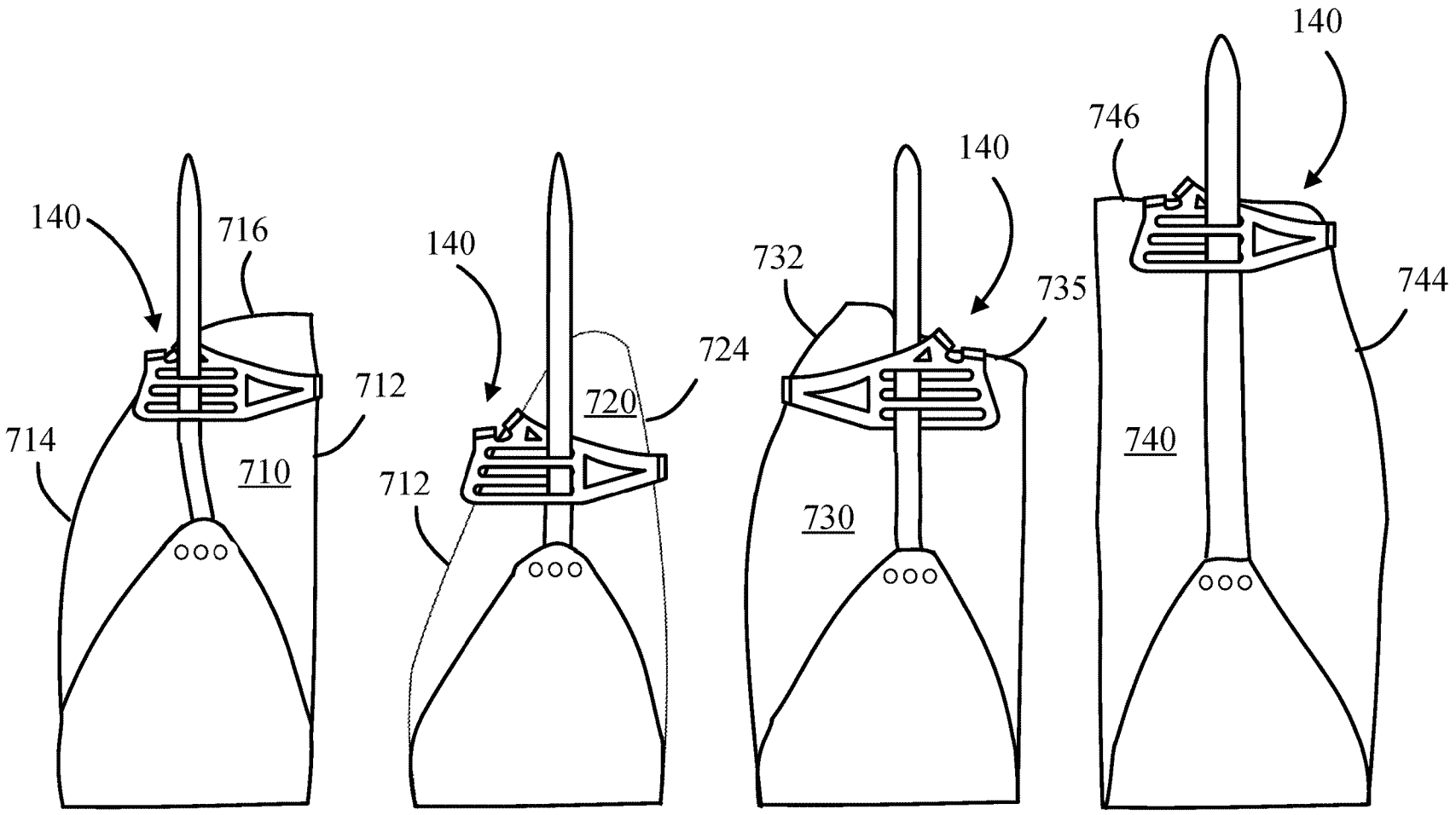
FIG. 7 illustrates a splitboard and tail clip interface on various splitboard ski designs, in accordance with various embodiments.

Referring now to FIG. 7, various tail clip to splitboard interfaces are illustrated, in accordance with various embodiments. With combined reference to FIGS. 3A, 5, and 7, the first hook 320 of tail clip 140 is configured to engage either an inboard edge or an outboard edge of a splitboard ski assembly (e.g., inboard edge 712 of a standard splitboard 710, outboard edge 724 of a deep swallowtail splitboard 720, inboard edge 732 of a shallow swallowtail splitboard 730, and an outboard edge 744 of a square splitboard 740). Similarly, at least one of second hook 330 and third hook 340 is configured to engage a tail edge, an inboard edge, and/or an outboard edge (e.g., outboard edge 714 and/or tail edge 716 of a standard splitboard 710, inboard edge 722 of a deep swallowtail splitboard 720, outboard/tail edge 735 of a shallow swallowtail splitboard 730, and tail edge 746 of a square splitboard 740). In various embodiments, tail clip 140 is adaptable to various ever changing splitboard ski assembly designs. Although illustrated and discussed with respect to a three hook configuration, any additional number of hooks is within the scope of this disclosure. For example, a four hook tail clip may provide additional adaptability to changing ski designs, or the like.

Figure 8:
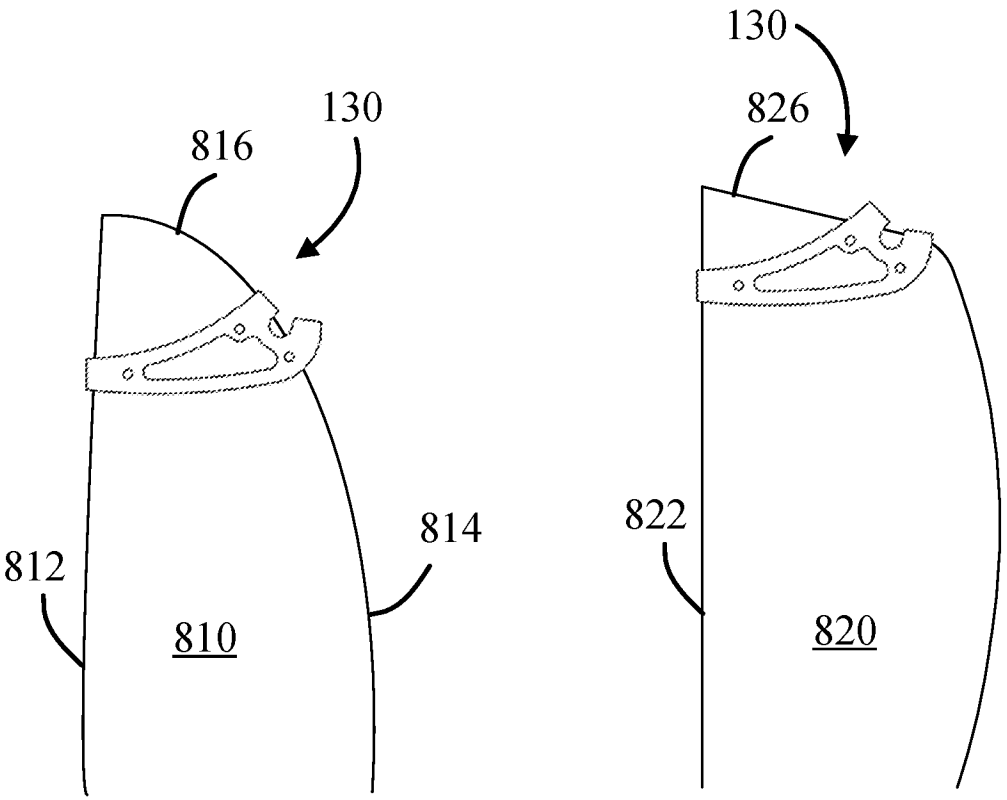
FIG. 8 illustrates a splitboard and nose clip interface on various splitboard ski designs, in accordance with various embodiments.

Referring now to FIG. 8, various nose clip to splitboard interfaces are illustrated, in accordance with various embodiments. With combined reference to FIGS. 2 and 8, first hook 220 is configured to engage either an inboard edge of a splitboard ski assembly (e.g., inboard edge 812 of a splitboard 810 with a gradual nose shape, and inboard edge 822 of a splitboard 820 with a blunt nose shape). Similarly, at least one of second hook 230 or third hook 240 of nose clip 130 is configured to engage a nose edge and/or an outboard edge of a splitboard ski assembly (e.g., outboard edge 814 and/or nose edge 816 of a splitboard 810 with a gradual nose shape, and a nose edge 826 of a splitboard 820 with a blunt nose edge). Although illustrated with respect to blunt and gradual nose shapes, nose clips for various types of nose shapes are within the scope of this disclosure.

A tail clip is disclosed herein. In various embodiments, the tail clip comprises a plate portion comprising a mating surface disposed opposite an outer surface; a first hook extending outward from the mating surface; a second hook extending outward from the mating surface; a third hook extending outward from the mating surface; a first elongated aperture disposed through the plate portion; and a second elongated aperture disposed through the plate portion, wherein the second elongated aperture is disposed adjacent to the first elongated aperture and defines a first rail therebetween. In various embodiments, the first hook comprises a first bending plane defining a first perpendicular axis, the second hook comprises a second bending plane defining a second perpendicular axis, and the third hook comprises a third bending plane defining a third perpendicular axis, the second perpendicular axis being offset from the first perpendicular axis by between 110 degrees and 140 degrees, and the third perpendicular axis being offset from the first perpendicular axis by between 90 degrees and 120 degrees.

A nose clip is disclosed herein. The nose clip may comprise a plate portion comprising a mating surface disposed opposite an outer surface, a first leg, a second leg, and a third leg; a first hook extending outward from the mating surface; a second hook extending outward from the mating surface, wherein the first leg extends from the first hook to the second hook; and a third hook extending outward from the mating surface, wherein the second leg extends from the first hook to the second hook, and the third leg extends from the second hook to the third hook.

A stretcher is disclosed herein. The stretcher may comprise a base configured to be coupled to a skin of a splitboard ski assembly; and a strap extending from the base, wherein the strap comprises a plurality of protrusions extending outward from a surface of the strap, and wherein the strap is configured to provide a friction interface with a tail clip of the splitboard ski assembly. In various embodiments, the plurality of protrusions is aligned in rows, each row of protrusions forming a chevron shape.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. § 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A tail clip kit for a splitboard ski system, comprising:

a tail clip comprising a plurality of hooks configured to engage a tail end of a splitboard ski, the tail clip including a plurality of elongated apertures; and a stretcher comprising a base and a strap, the base configured to be coupled to a skin of a splitboard ski assembly, the strap extending outward from the base and configured to engage the plurality of elongated apertures, the strap configured to provide a friction interface with the tail clip.

2. The tail clip kit of claim 1, wherein the stretcher further comprises a plurality of protrusions extending outward from a surface of the strap.

3. The tail clip kit of claim 2, wherein the plurality of protrusions is aligned in rows, each row of protrusions forming a chevron shape.

4. The tail clip kit of claim 1, wherein:

the tail clip further comprises a plate portion, the plurality of elongated apertures includes a first elongated aperture and a second elongated aperture, the first elongated aperture and the second elongated aperture are each disposed through the plate portion, and the first elongated aperture is disposed adjacent to the second elongated aperture and defines a first rail therebetween.

5. The tail clip kit of claim 4, wherein the plurality of elongated apertures further comprises a third elongated aperture disposed adjacent to the second elongated aperture and defines a second rail therebetween.

6. The tail clip kit of claim 5, wherein the strap of the stretcher is configured to create the friction interface with the first rail and the second rail.

7. The tail clip kit of claim 1, wherein:

the plurality of hooks comprises a first hook, a second hook, and a third hook, and the first hook, the second hook, and the third hook each extend outward from a mating surface of the tail clip.

8. The tail clip kit of claim 7, wherein the first hook comprises a first bending plane defining a first perpendicular axis, the second hook comprises a second bending plane defining a second perpendicular axis, and the third hook comprises a third bending plane defining a third perpendicular axis, the second perpendicular axis being offset from the first perpendicular axis by between 110 degrees and 140 degrees, and the third perpendicular axis being offset from the first perpendicular axis by between 90 degrees and 120 degrees.

9. The tail clip kit of claim 1, further comprising a plurality of fasteners configured to couple the base of the stretcher to the skin.

10. A tail clip kit of claim 1, wherein:

each elongated aperture in the plurality of elongated apertures is elongated in a lateral direction, each elongated aperture in the plurality of elongated apertures is spaced apart in a longitudinal direction from an adjacent elongated aperture in the plurality of elongated apertures, the tail clip is adaptable to various splitboard shapes, the stretcher is configured to be offset from a lateral center of an elongated aperture in the plurality of elongated apertures in a first lateral direction in response to the tail clip engaging a first board shape of the various splitboard shapes, the stretcher is configured to be offset from the lateral center in a second lateral direction in response to the tail clip engaging a second board shape of the various splitboard shapes, the second lateral direction being opposite the first lateral direction, and the stretcher is configured to be substantially aligned through the lateral center in response to the tail clip engaging a third board shape of the various splitboard shapes.

11. The tail clip kit of claim 10, wherein the stretcher is configured to have at least one of an obtuse angle and an acute angle relative to the longitudinal direction.

12. A skin assembly for a splitboard ski assembly, comprising:

a splitboard skin extending from a nose end to a tail end;

a nose clip coupled to the nose end of the splitboard skin; and a stretcher comprising a base, a strap, and a plurality of protrusions extending outward from a surface of the strap, wherein:

the base is coupled to the tail end, the strap extends away from the tail end distal to the nose end, and the strap is configured to provide a friction interface with a tail clip of the splitboard ski assembly.

13. The skin assembly of claim 12, wherein the plurality of protrusions is aligned in rows, each row of protrusions forming a chevron shape.

14. The skin assembly of claim 12, wherein:

the nose clip comprises a plate portion, a first hook, a second hook, and a third hook, and the first hook, the second hook, and the third hook each extend outward from a mating surface of the plate portion.

15. The skin assembly of claim 14, wherein:

the nose clip further comprises a first leg, a second leg, and a third leg, the first leg extends from the first hook to the second hook, the third leg extends from the second hook to the third hook, and the second leg extends from the first hook to the second hook.

16. A splitboard skin system, comprising:

a tail clip comprising a first hook, a second hook, a third hook, and a plurality of elongated apertures; and a skin assembly, comprising;

a splitboard skin;

a nose clip coupled to a nose end of the splitboard skin; and a stretcher extending from a tail end of the splitboard skin distal to the nose end, the stretcher configured to frictionally engage at least one rail defined by the plurality of elongated apertures.

17. The splitboard skin system of claim 16, wherein a length of an aperture in the plurality of elongated apertures is substantially longer than a width of the stretcher.

18. The splitboard skin system of claim 16, wherein the plurality of elongated apertures includes:

a first elongated aperture disposed adjacent to a second elongated aperture defining a first rail therebetween; and a third elongated aperture disposed adjacent to the second elongated aperture defining a second rail therebetween.

19. The splitboard skin system of claim 18, wherein the first elongated aperture, the second elongated aperture, and the third elongated aperture each extend in a lateral direction and are spaced apart in a longitudinal direction.

20. The splitboard skin system of claim 16, wherein:

the nose clip is configured to engage a first end of a splitboard ski, and the tail clip is configured to engage a second end of the splitboard ski.

21. The splitboard skin system of claim 16, wherein:

the stretcher includes a stretcher axis defined by a stretcher edge of the stretcher, the stretcher edge defined by an intersection between a first surface and a side surface of the stretcher, the first surface including a plurality of protrusions extending therefrom, an elongated aperture in the plurality of elongated apertures includes an elongated aperture axis defined by a centerline of the elongated aperture in an elongation direction, and the splitboard skin system is configured to accommodate an angle between the stretcher axis and the elongated aperture axis being one of acute or obtuse.

22. A tail clip, comprising:

a plate portion;

a plurality of hooks extending from the plate portion;

a plurality of elongated apertures extending through the plate portion, wherein:

the tail clip configured to engage a tail end of a splitboard ski, each elongated aperture in the plurality of elongated apertures is elongated in a lateral direction and spaced apart in a longitudinal direction, the tail clip is adaptable to various splitboard shapes, the tail clip is configured to receive a stretcher that is offset from a lateral center of an elongated aperture in the plurality of elongated apertures in a first lateral direction in response to the tail clip engaging a first board shape of the various splitboard shapes, the tail clip is configured to receive the stretcher that is offset from the lateral center in a second lateral direction in response to the tail clip engaging a second board shape of the various splitboard shapes, the second lateral direction being opposite the first lateral direction, and the tail clip is configured to receive the stretcher that is substantially aligned with the lateral center in response to the tail clip engaging a third board shape of the various splitboard shapes.

23. A skin assembly for a splitboard ski assembly, comprising:

a splitboard skin extending from a nose end to a tail end;

a nose clip coupled to the nose end of the splitboard skin; and a stretcher comprising a base and a strap, wherein:

the base is coupled to the tail end, the strap extends away from the tail end distal to the nose end, the strap is configured to provide a friction interface with a tail clip of the splitboard ski assembly, the nose clip comprises a plate portion, a first hook, a second hook, and a third hook, and the first hook, the second hook, and the third hook each extend outward from a mating surface of the plate portion.

* * * * *